US006361418B1

(12) United States Patent
Inada

(10) Patent No.: US 6,361,418 B1
(45) Date of Patent: Mar. 26, 2002

(54) ABRASIVE SYSTEM

(75) Inventor: Yasuo Inada, Nagano (JP)

(73) Assignee: Fujikoshi Kikai Kogyo Kabushiki Kaisha, Nagano (JP)

( * ) Notice: Subject to any disclaimer, the term of this patent is extended or adjusted under 35 U.S.C. 154(b) by 0 days.

(21) Appl. No.: 09/547,659

(22) Filed: Apr. 12, 2000

(30) Foreign Application Priority Data

Apr. 13, 1999 (JP) ..... 11-105407

(51) Int. Cl.[7] ..... B24B 7/00
(52) U.S. Cl. ..... 451/262; 451/270
(58) Field of Search ..... 451/5, 6, 41, 63, 451/57, 259, 270, 269, 268, 262, 264, 271

(56) References Cited

U.S. PATENT DOCUMENTS 4,502,252 A * 3/1985 Iwabuchi ..... 451/269
4,773,185 A * 9/1988 Taira ..... 451/269
5,121,572 A * 6/1992 Hilscher ..... 451/269
5,964,651 A * 10/1999 Hose ..... 451/269
6,135,854 A * 10/2000 Masumura et al. ..... 451/6
6,139,408 A * 10/2000 Hakomori ..... 451/269

FOREIGN PATENT DOCUMENTS

JP 9-252100 9/1997
JP 10-202511 8/1998

* cited by examiner

*Primary Examiner*—Derris H. Banks
(74) *Attorney, Agent, or Firm*—Jordan and Hamburg LLP

(57) ABSTRACT

The abrasive system of the present invention is capable of automatically and efficiently feeding and discharging work pieces. In the abrasive system, an upper abrasive plate and a lower abrasive plate pinch the work pieces, which are provided in through-holes of a carrier and abrade both faces of each work piece. A carrier driving mechanism moves the carrier, along a circular orbit, without spinning, together with the work pieces. Stopping means stops the movement of the carrier at a predetermined position. The feeding-and-discharging means includes: an arm robot having a work holding unit, which is provided to a front end and capable of holding and releasing the work piece; and an image processing unit for recognizing shapes and positions of the through-holes of the carrier and the work pieces.

4 Claims, 7 Drawing Sheets

ABRASIVE SYSTEM

BACKGROUND OF THE INVENTION

The present invention relates to an abrasive system, more precisely relates to an abrasive system, which is capable of simultaneously abrading both faces of each work piece.

The inventor of the present invention invented and filed an abrasive machine. The abrasive machine has been already disclosed in the Japanese Patent Gazette No. 10-202511.

The abrasive machine comprises: a carrier formed into a thin plate having a plurality of through-holes;

an upper abrasive plate and a lower abrasive plate pinching work pieces, each of which is provided in each through-hole, from an upper side and a lower side and abrading both faces of each work piece; and a carrier driving mechanism moving the carrier, in a plane, along a circular orbit without spinning so as to move the work pieces, which are pinched between the abrasive plates, with respect to the abrasive plates, along circular orbits without spinning. Note that, the upper abrasive plate and the lower abrasive plate are capable of independently spinning.

However, in the conventional abrasive machine, the work pieces are not automatically fed and taken out.

Namely, the work pieces are manually fed into the through-holes of the carrier and manually taken out therefrom. By manually handling the work pieces, the work pieces are sometimes polluted and damaged. Further, manufacturing efficiency cannot be improved. Therefore, an abrasive system, which is capable of automatically handling the work pieces, has been required.

To properly abrade the work pieces in the through-holes of the carrier, a clearance between an outer edge of the work piece, e.g., a silicon wafer, and an inner edge of the through-hole is designed 1 mm or less. The carrier is the thin plate, so it is apt to be slightly waved. Further, there is carrier with a carrier holder. Therefore, it is difficult to correctly position the through-holes at predetermined positions, so that it is also difficult to automatically feed the work pieces into the through-holes and discharge therefrom with high accuracy.

SUMMARY OF THE INVENTION

An object of the present invention is to provide an abrasive, which is capable of automatically and efficiently feeding and discharging work pieces with high accuracy.

The abrasive system of the present invention comprises:

a carrier being formed into a thin plate having a plurality of through-holes;

an upper abrasive plate and a lower abrasive plate pinching work pieces, each of which is provided in each through-hole, from an upper side and a lower side and abrading both faces of each work piece;

a carrier driving mechanism moving the carrier, in a plane, along a circular orbit without spinning so as to move the work pieces, which are pinched between the abrasive plates, with respect to the abrasive plates, along circular orbits, without spinning;

means for stopping the movement of the carrier at a predetermined position, the stopping means being provided to the carrier driving mechanism; and means for feeding and discharging the work pieces, the feeding-and-discharging means including:

an arm robot having a work holding unit, which is provided to a front end and capable of holding and releasing the work piece, the arm robot feeding the work pieces into the through-holes of the carrier, which is stopped at the predetermined position, and discharging the abraded work pieces therefrom; and an image processing unit for recognizing shapes and positions of the through-holes of the carrier and the work pieces.

With this structure, the stopping means stops the carrier at the predetermined position, then the work pieces can be precisely positioned, by the image processing unit, in the through-holes of the carrier. Further, the work holding unit can be precisely coincided with the work pieces in the through-holes by the image processing unit, so that the work pieces can be automatically and efficiently fed into and discharged from the through-holes. Since the through-holes are correctly positioned by the stopping means, positioning control of the work holding unit can be easy.

In the abrasive system, the carrier driving mechanism may include a servo motor, and the stopping means may include a control unit for controlling the servo motor. With this structure, the carrier can be correctly stopped at the predetermined position by a simple means.

The abrasive system may further comprise a carrier spinning mechanism for spinning the carrier about an axis. The carrier spinning mechanism may be capable of stopping the carrier at a predetermined angular position. With this structure, a plurality of work pieces can be moved to a predetermined position in order, so that the work pieces can be fed into and discharged from the through-holes by the arm robot whose stroke is short.

In the abrasive system, the arm robot may be a horizontal multi-joint robot, and the work holding unit and a camera of the image processing unit may be provided to a front end of the horizontal multi-joint robot. With this structure, the shapes and the positions of the through-holes of the carrier and the work pieces can be simultaneously recognized, so that the work pieces can be efficiently fed and discharged.

In the abrasive system, the arm robot may be a vertical multi-joint robot, which is capable of taking out the work pieces, which are vertically arranged in a cassette, and vertically storing the work pieces into another cassette. With this structure, additional means for taking out and storing the work pieces is not required, so that the system can be simple and compact.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present embodiments will now be described in detail with reference to the accompanying drawings.

Figure 1:
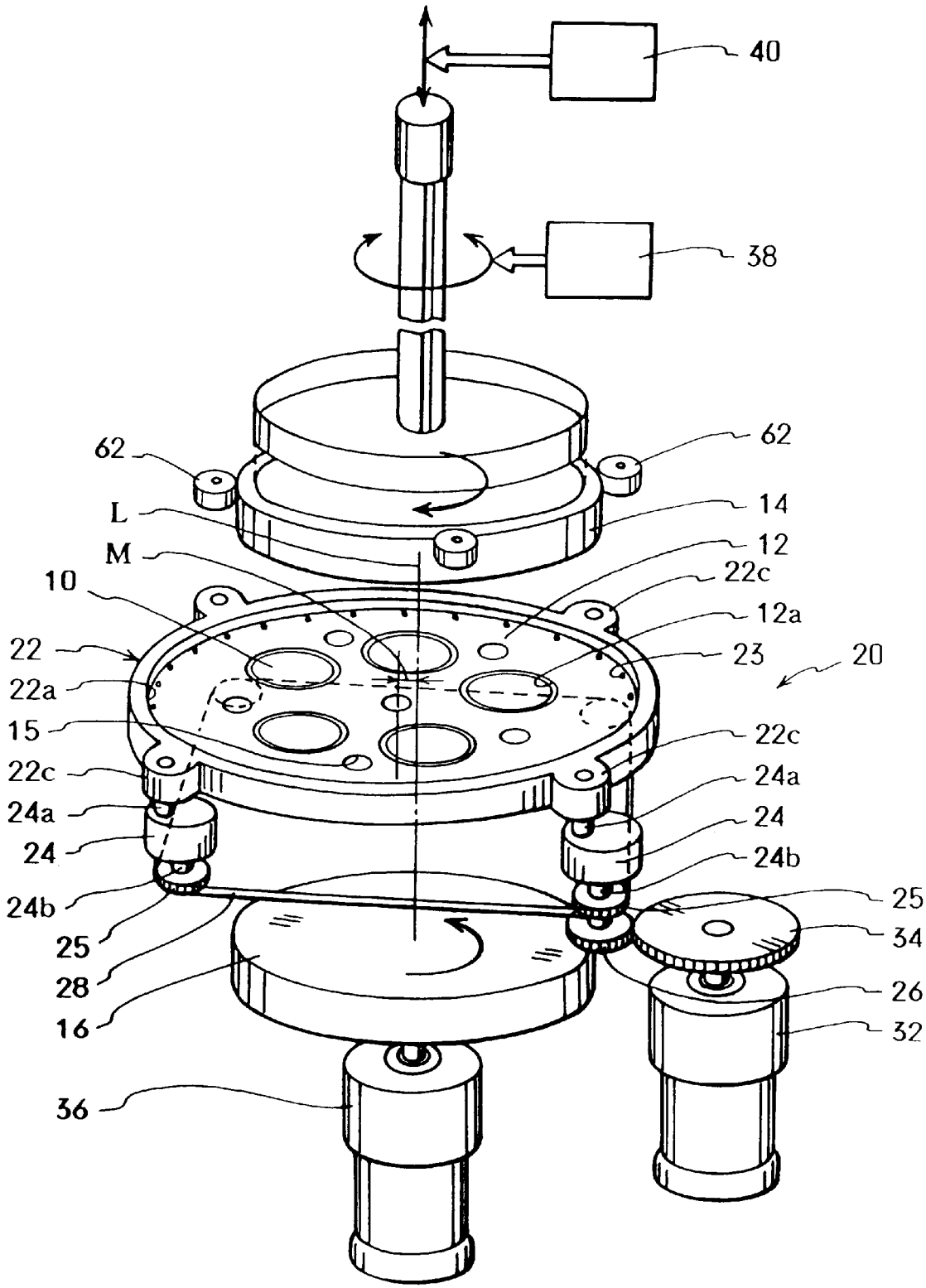
FIG. 1 is an exploded perspective view of an abrasive unit of the abrasive system of the present invention.
Figure 2:
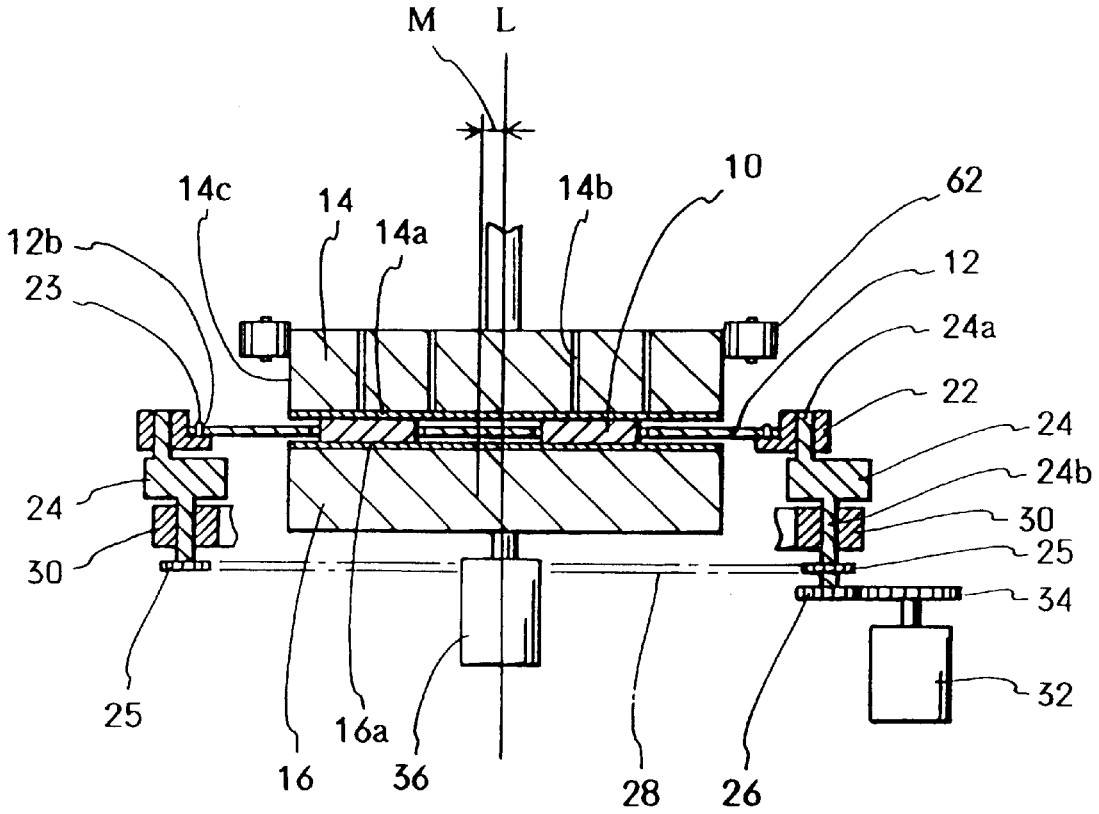
FIG. 2 is a side sectional view of the abrasive unit shown in FIG. 1.
Figure 3:
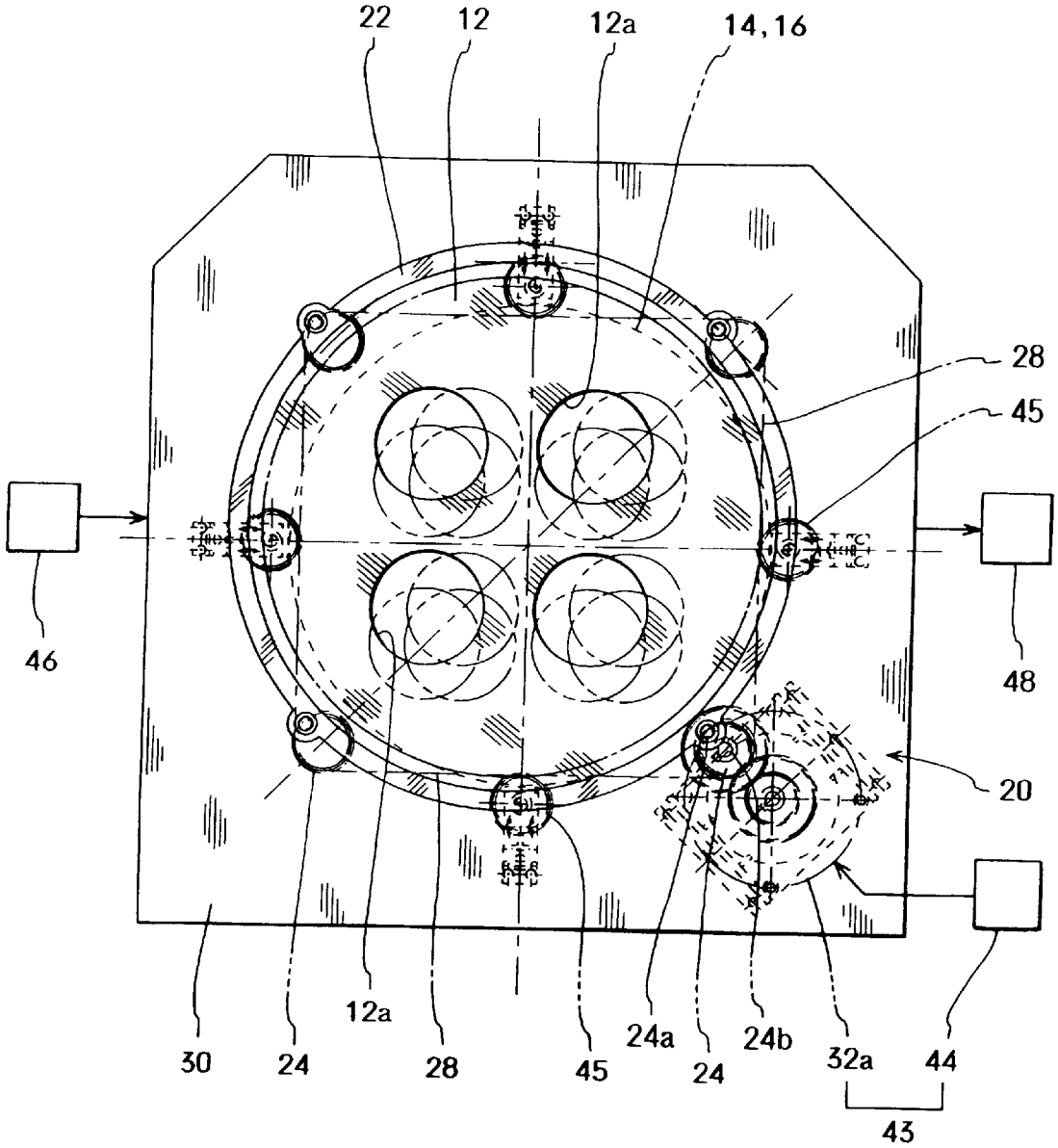
FIG. 3 is a plan view showing a method of feeding and discharging work pieces.

Firstly, an abrasive unit, which is capable of simultaneously abrading both faces of each work piece, will be explained with reference to FIGS. 1–3. FIG. 1 is an exploded perspective view of the abrasive unit; FIG. 2 is a side sectional view of the abrasive unit; and FIG. 3 is a plan view showing a method of feeding and discharging the work pieces.

In the embodiments, the abrasive system abrades thin silicon wafers 10 as the work pieces. The abrasive unit has: a carrier 12 being formed into a thin circular plate and having a plurality of through-holes 12*a*; an upper abrasive plate 14; and a lower abrasive plate 16. The abrasive plates 14 and 16 pinch the wafers 10, which have been provided in the through-holes 12*a*, and the wafers 10 are moved, with respect to the abrasive plates 14 and 16, together with the carrier 12, so that an upper and a lower faces of each wafer 10 can be simultaneously abraded. Abrasive cloth 14*a* is adhered on a bottom face of the upper abrasive plate 14 and constitutes an abrasive face; abrasive cloth 16*a* is adhered on an upper face of the lower abrasive plate 16 and constitutes an abrasive face. The abrasive plates 14 and 16 can be independently spun about their own axes, which are perpendicular to the carrier 12.

Each wafer 10 is formed into a circular disk and provided in each circular through-hole 12*a* with a play, so that the wafer 10 can be freely spun in the through-hole 12*a*.

The carrier 12 is, for example, a glass-epoxy plate. In the case of carrying the wafers 10 whose thickness is 0.8 mm, the thickness of the carrier 12 is about 0.7 mm.

A carrier driving mechanism 20 moves the carrier 12 in a plane together with the wafers 10, which are provided in the through-holes 12*a* and pinched between the abrasive plates 14 and 16.

The carrier driving mechanism 20 moves the carrier 12, along a circular orbit in the plane, without spinning about its own axis, so that the wafers 10, which are provided in the through-holes 12*a* and pinched between the abrasive plates 14 and 16, also moved, along circular orbits, without spinning about their axes.

A concrete example of the carrier driving mechanism 20 will be explained.

Firstly, means for connecting the carrier 12 with a carrier holder 22 will be explained.

In the present embodiments, the carrier holder 22 has pins 23; the carrier 12 has long holes 12*b*, in each of which each pin 23 is inserted with a play. The long holes 12*b* is extended in the radial direction of the carrier 12 (see FIG. 2) because of heat expansion. Clearance between the pin 23 and an inner edge of the long hole 12*b* is designed to absorb the heat expansion of the carrier 12. With this structure, the heat expansion of the carrier 12 can be absorbed and the carrier 12 can be connected with and held in the carrier holder 22 without spinning.

There is a clearance between an outer edge of the carrier 12 and an inner circumferential face 22*a* of the carrier holder 22 so as to absorb the heat expansion of the carrier 12. Namely, an inner diameter of the carrier holder 22 is slightly greater than an outer diameter of the carrier 12.

By respectively inserting the pins 23 of the carrier holder 22 into the long holes 12*b* of the carrier 12, the carrier 12 can be set and held in the carrier holder 22.

By employing the connecting means, the carrier 12 can be connected with the carrier holder 22 without spinning and the heat expansion of the carrier 12 can be properly absorbed.

By absorbing the heat expansion of the carrier 12, deformation of the carrier 12 can be prevented. Since the carrier 12 can be easily set in the carrier holder 22, working efficiency can be improved.

Each crank member 24 has: a holder shaft 24*a*, which is pivotably connected to the carrier holder 22 and whose axis is parallel to the axis "L" of the abrasive plates 14 and 16; and a base shaft 24*b*, which is separated from the holder shaft 24*a* and pivotably connected to a base 30 (see FIG. 2) and whose axis is also parallel to the axis "L" of the abrasive plates 14 and 16. Namely, the crank member 24 is formed like a crank arm.

In the present embodiments, four crank members 24 are provided between the base 30 and the carrier holder 22. The crank members 24 support the carrier holder 22 and moves the carrier holder 22, along a circular orbit, without spinning, by rotating the crank members 24 about the base shafts 24*b*. The holder shafts 24*a* are respectively pivotably fitted in bearing sections 22*c*, which are projected from an outer circumferential face of the carrier holder 22. With this structure, an axis of the carrier 12 is shifted a distance "M" from the axis "L" of the abrasive plates 14 and 16, and the carrier 12 can be moved, along a circular orbit, without spinning. A radius of the circular orbit of the carrier 12 is equal to a distance between the holder shaft 24*a* and the base shaft 24*b* (the distance "M"). Therefore, all points in the carrier 12 can be moved along circular orbits, whose radiuses are same.

A timing chain 28 is engaged with four sprockets 25, which are respectively fixed to the base shafts 24*b* of the crank members 24. The timing chain 28 and the four sprockets 25 link the four base shafts 24*b* so as to synchronously move the four crank members 24. The synchronous mechanism has a simple structure and is capable of stably moving the carrier 12. By the stable movement of the carrier 12, abrading accuracy and flatness of the wafers can be improved. Note that, a timing belts, gears, etc. may be employed as the synchronous mechanism.

An output gear 34 is fixed to an output shaft of a motor 32. The output gear 34 is engaged with a gear 26, which is fixed to one of the base shafts 24*b* of the crank members 24. With this structure, the crank members 24 can be rotated about the base shafts 24*b*.

The four crank members 24 may be rotated by four electric motors, which are electrically synchronized so as to smoothly move the carrier 12.

Number of the crank members 24 is not limited to four. The number should be three or more to properly support the carrier holder 22.

In the case that the carrier holder 22 is integrated with a moving body of an X-Y table which is capable of moving in the X- and Y-directions, the carrier holder 22 can be moved round, without spinning, by one crank member 24. Since the moving body is slidably engaged with two guides, which are respectively arranged in the X- and Y-directions, so that the moving body and the carrier holder 22 are moved round without spinning.

In the case that the moving body of the X-Y table is driven by driving means, no crank members 24 are required. Namely, the moving body and the carrier holder 22 are moved in the X- and Y-directions, by the driving means, e.g., two servo motors and two ball screws, two servo motors and two timing chains, without spinning. In this case, at least two motors are required, but many abrasive pattern can be designed by controlling the two motors.

A motor 36 rotates the lower abrasive plate 16. For example, an output shaft of the motor 36 is directly connected to a shaft of the lower abrasive plate 16.

Driving means 38 rotates the upper abrasive plate 14.

The motor 36 and the driving means 38 can control rotational speed and rotational direction of the abrasive plates 14 and 16, so that abrading conditions can be controlled.

As shown in FIG. 2, the wafers 10, which are provided in the through-holes 12*a* of the carrier 12, are sandwiched and abraded by the upper abrasive plate 14 and the lower abrasive plate 16. Pressing force applied to the wafer 10 is adjusted by a pressurizing unit, which is provided to the upper abrasive plate 14. For example, an air bag may be the pressurizing unit. Weight of the upper abrasive plate 14 works to the wafers 10 as the maximum pressing force, and the pressing force can be reduced by pressurizing the air bag, so that the pressing force can be controlled properly.

Note that, an elevating unit 40, which is capable of vertically moving the upper abrasive plate 14, is also provided to the upper abrasive plate 14, and it is operated when the wafers 10 are fed and discharged.

Next, means for supplying slurry will be explained.

The upper abrasive plate 14 has a plurality of slurry holes 14*b*, through which the slurry is supplied to a part between the abrasive face 14*a* of the upper abrasive plate 14 and the upper face of the wafers 10.

The slurry holes 14*b* are capable of uniformly supplying the slurry onto the whole upper face of the wafers 10. As far as no bad influences are occurred, number and size of the slurry holes 14*b* can be freely designed. In the present embodiments, the small slurry holes 14*b* are matrically arranged in the upper abrasive plate 14 so as to uniformly supply. The slurry holes 14*b* are vertically formed in the upper abrasive plate 14 as through-holes.

Tubes (not shown) for supplying the slurry are connected to upper ends of the slurry holes 14*b*. The slurry, which is exerted by a pump, etc., is supplied via the tubes.

The carrier 12 has a plurality of slurry holes 15, through which the slurry, which has been supplied through the slurry holes 14*b*, is supplied to a part between the abrasive face 16*a* of the lower abrasive plate 16 and the lower face of the wafers 10.

The slurry holes 15 are designed so as not to badly influence strength of the carrier 12. As far as no bad influences are occurred, number and size of the slurry holes 15 can be freely designed. For example, as shown in FIG. 1, six circular slurry holes 15 are formed at a center of the carrier 12 and parts between the adjacent through-holes 12*a*.

By employing the carrier 12 having the slurry holes 15, the slurry can be properly supplied to the both faces (the upper and lower faces) of the wafers 10, so that the both faces can be properly abraded. Namely, the liquid slurry can flow down through the slurry holes 15 and reach the lower faces of the wafers 10. Therefore, the both faces of the wafers 10 can be uniformly abraded with high accuracy.

The slurry on the abrasive face 16*a* radically flows out from the outer edge of the abrasive face 16*a*, and it will be collected to reuse.

In FIG. 1, rollers 62 contact the upper abrasive plate 14 so as to prevent the upper abrasive plate 14 from swinging in a horizontal plane. The rollers 62 are rotatably attached to a holding section (not shown), which is provided to the base 30 and in the vicinity of the upper abrasive plate 14, so as to contact the outer circumferential face of the upper abrasive plate 14. By pinching the upper abrasive plate 14 with the rollers 62, the horizontal swing of the upper abrasive plate 14 can be prevented, so that vibration of the abrasive unit can be prevented.

Means for stopping the movement of the carrier 12 will be explained with reference to FIG. 3. Note that, structural elements explained above are assigned the same symbols and explanation will be omitted.

The stopping means 43 is provided to the carrier driving mechanism 20 so as to stop the carrier 12 at a predetermined position. When the wafers 10 are fed or supplied to the carrier 12, the through-holes 12*a* should be positioned at predetermined angular positions; when the abraded wafers 10 are discharged or taken out from the carrier 12, the abraded wafers 10, which are in the through-holes 12*a*, should be positioned at predetermined angular positions.

The predetermined angular positions may be always fixed. In some cases, the predetermined angular positions may be moved, with respect to initial positions, on the basis of a rule. Namely, the predetermined angular positions are defined with respect to a position of means for feeding and discharging the wafers 10.

The stopping means 43 is a servo mechanism comprising: a servo motor 32*a* for driving the carrier holder 22, which holds the carrier 12; and a control unit 44 for controlling the servo motor 32*a*. By employing the servo motor 32*a*, the stopping means 43 is capable of correctly positioned the carrier 12 by a simple structure, so that manufacturing cost can be reduced.

The stopping means 43 is not limited to the servo mechanism, it may include a sensor, which is provided to the base 30 and capable of detecting a mark, which is marked at a prescribed position on the outer circumferential face of the carrier holder 22. When the sensor detects the mark, a detection signal of the sensor stops the movement of the carrier holder 22, so that the carrier 12 can be stopped at the predetermined angular position.

Further, the mark may be provided to a prescribed position on an outer circumferential face of the crank member 24, which is formed as a circular cylinder, and the sensor for detecting the mark may be provided to the base 30. In this case, the same effect can be gained.

Work feeding means 46 feeds or supplies the wafers 10 into the through-holes 12*a* of the carrier 12, which has been stopped by the stopping means 43.

Work discharging means 48 discharges or taken out the abraded wafers 10 from the through-holes 12*a* of the carrier 12, which has been stopped by the stopping means 43.

Since the carrier 12 is stopped at the predetermined position by the stopping means 43, the feeding means 46 and the discharging means 48 can easily know the positions of the through-holes 12*a* of the carrier 12, so that they can easily feeding and discharging the wafers 10 every time. Therefore, structures of the feeding means 46 and the discharging means 48 can be simple, and the feeding means 46 and the discharging means 48 can be controlled easily.

Tension roller 45 applies tension to the timing chain 28 so as to securely synchronize the crank members 24.

Figure 4:
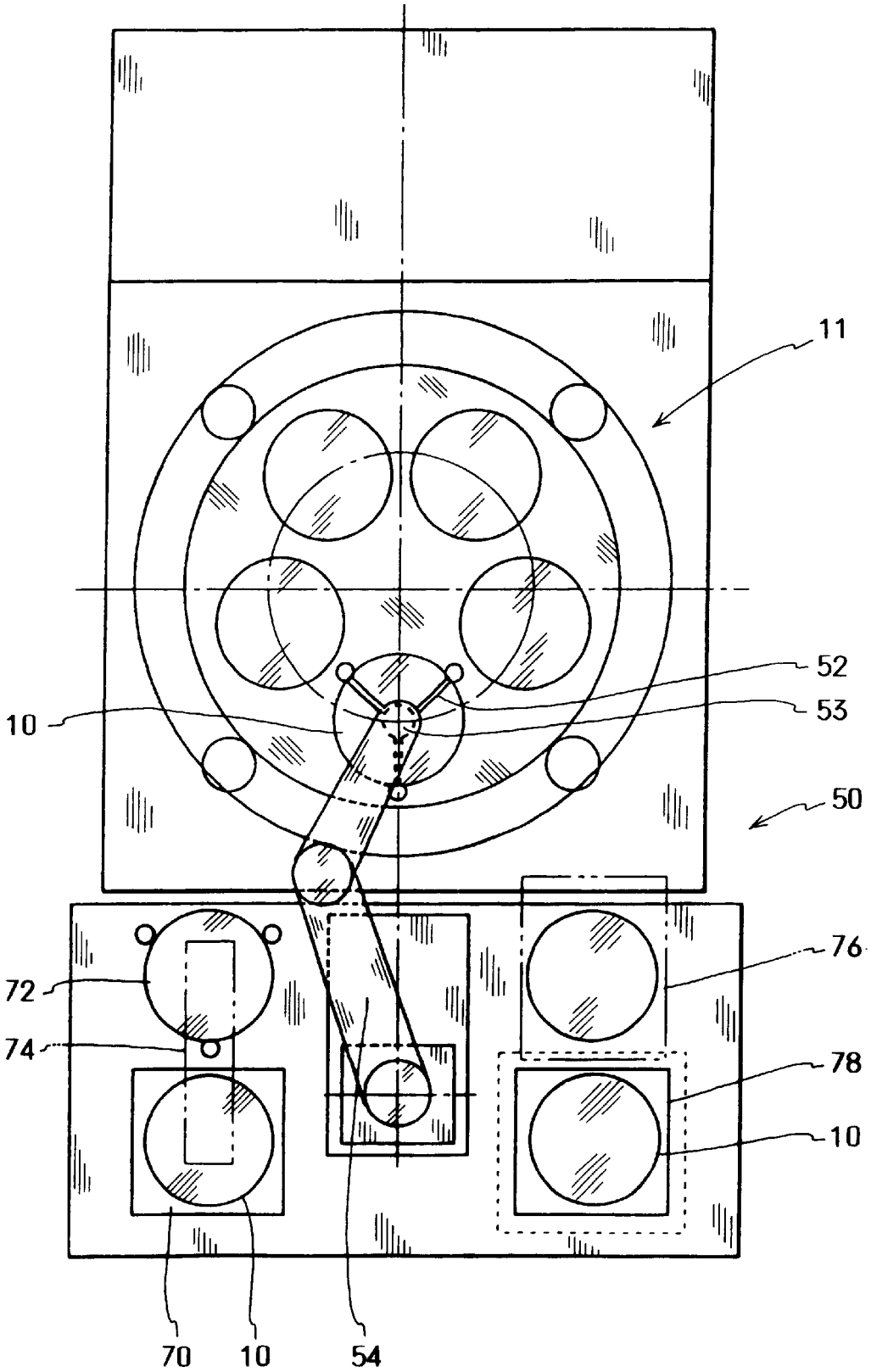
FIG. 4 is a plan view of the abrasive system of a first embodiment.
Figure 5:
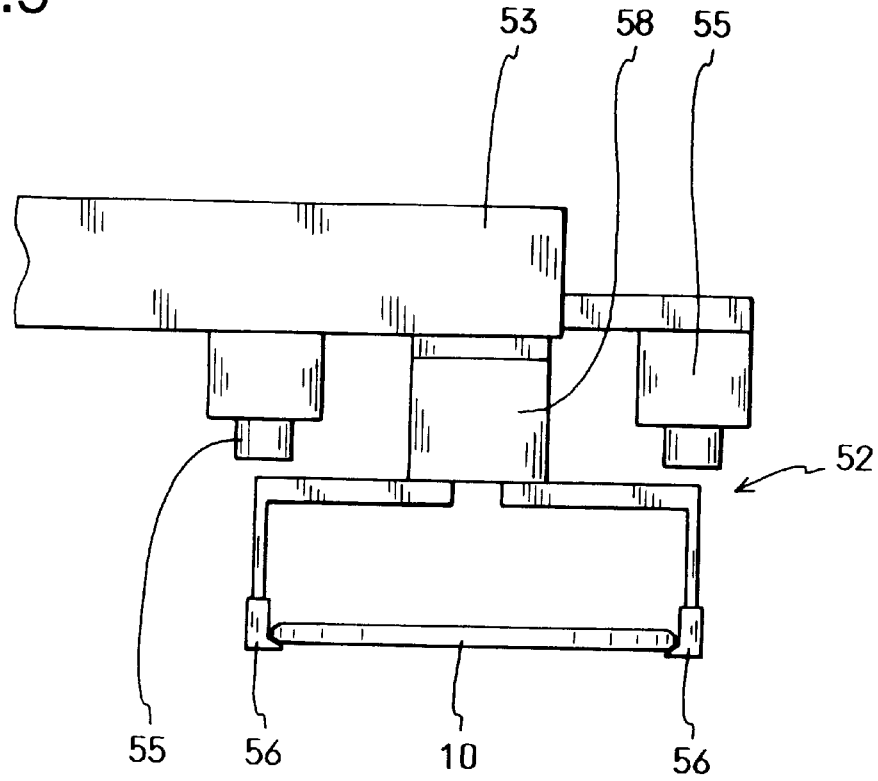
FIG. 5 is a side view of a front end of an arm robot.
Figure 6:
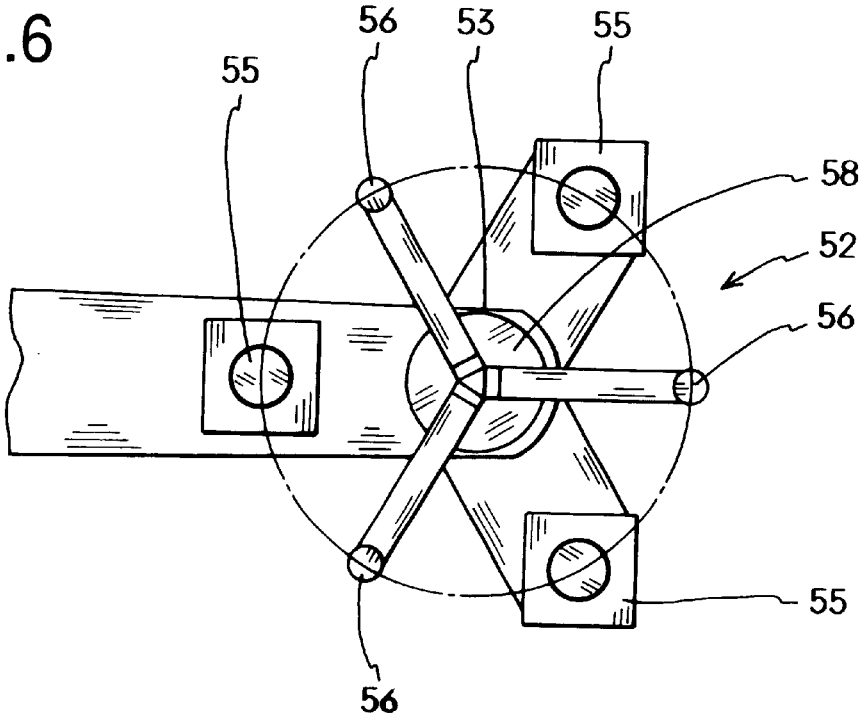
FIG. 6 is a bottom view of the front end of the arm robot.
Figure 7:
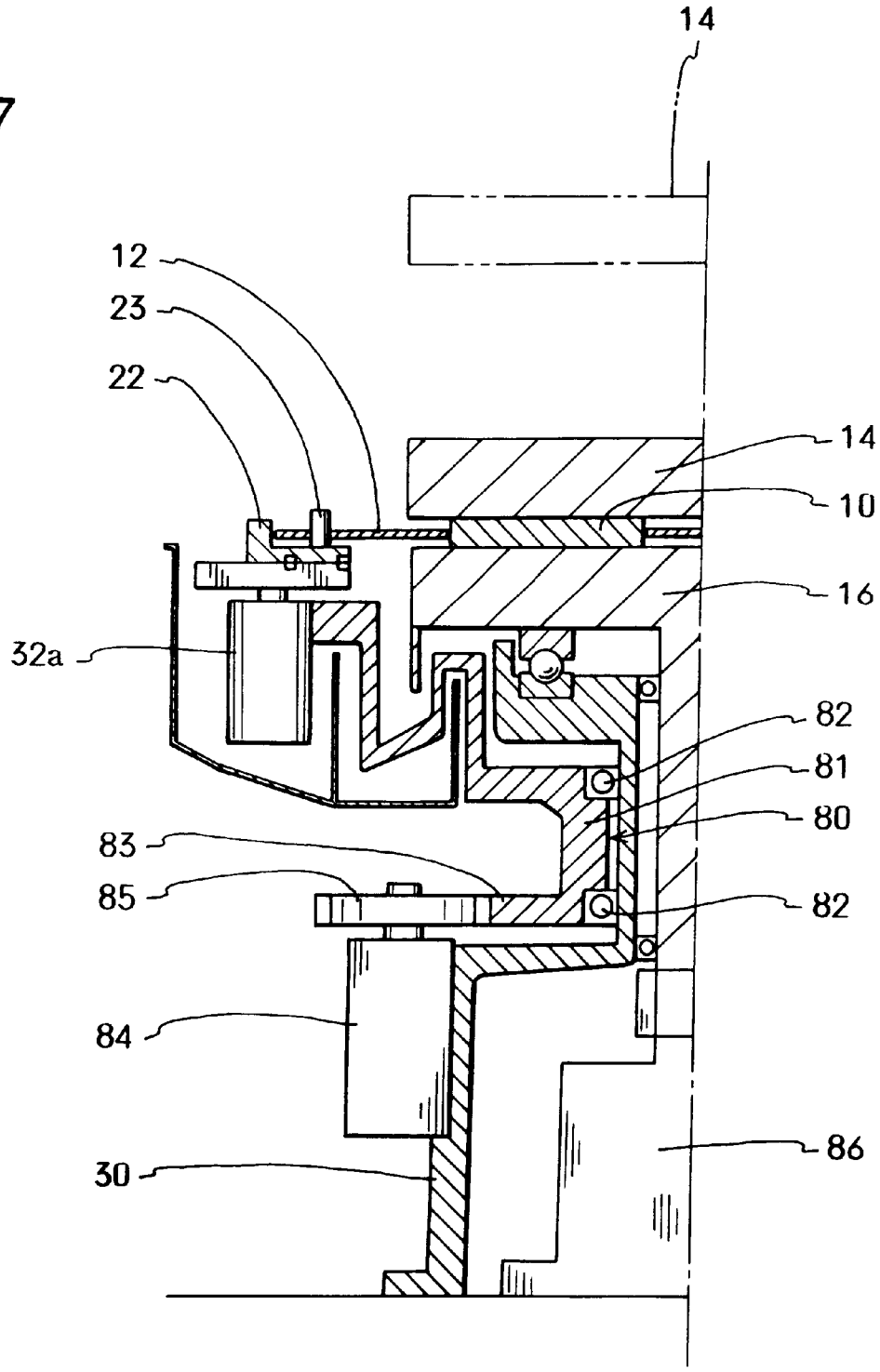
FIG. 7 is a sectional view of a carrier spinning mechanism.
Figure 8:
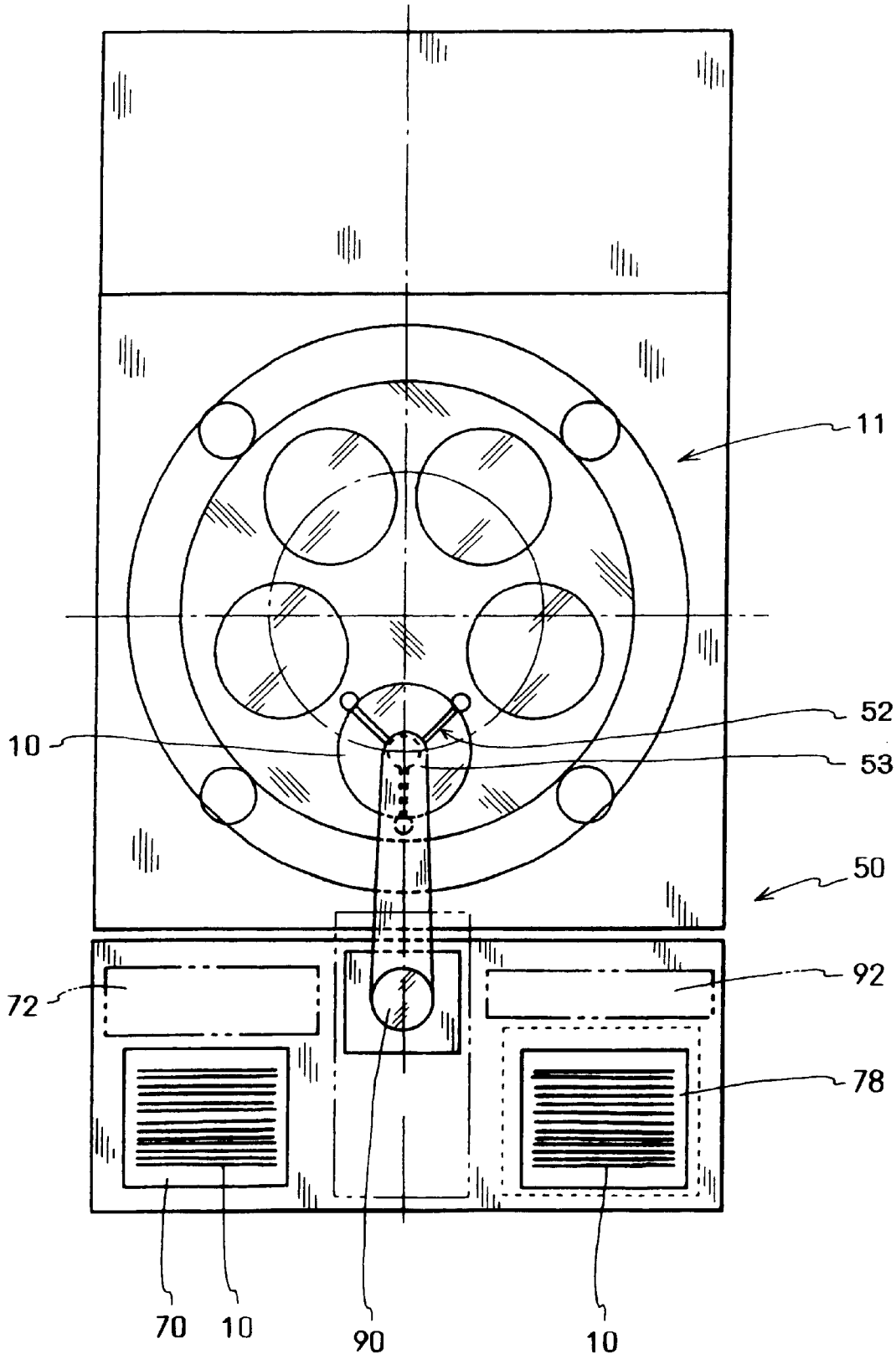
FIG. 8 is a plan view of the abrasive system of a second embodiment.

Next, the means for feeding and discharging the wafers 10 will be described in detail, as a first embodiment, with reference to FIGS. 4–7. A second embodiment will be described with reference to FIG. 8. FIG. 4 is a plan view of the abrasive system of the first embodiment; FIG. 5 is a side view of a front end of an arm robot; FIG. 6 is a bottom view of the front end of the arm robot; and FIG. 7 is a sectional view of a carrier spinning mechanism. FIG. 8 is a plan view of the abrasive system of the second embodiment. Note that, the structural elements shown in FIGS. 1–3 are assigned the same symbols and explanation will be omitted.

The abrasive unit 11 (see FIGS. 1 and 2) has the carrier 12, which is moved round without spinning. The abrasive unit 11 has the stopping means 43 (see FIG. 3), which includes the servomotor 32*a* (see FIG. 7). Unlike the abrasive unit shown in FIGS. 1–3, in which the carrier holder 22 is rotated by the one servo motor 32*a*, the chain 28*a* and the four crank members 24, the carrier holder 22 of the first embodiment is rotated three synchronized servo motors 32*a*. By using the three synchronized servo motors 32*a*, the carrier 12 can be smoothly moved round without spinning.

The feeding-and-discharging means 50 is capable of securely feeding the wafers 10 into the through-holes 12*a* of the carrier 12, which has been stopped by the stopping means 43, and discharging the abraded wafers 10 from the through-holes 12*a* of the carrier 12, which has been stopped by the stopping means 43. Thus, the feeding-and-discharging means 50 comprises: a horizontal multi-joint arm robot 54; a work holding unit 52, which is provided to a front end section 53 of the arm robot 54; and an image processing unit for recognizing shapes and positions of the through-holes 12*a* of the carrier 12 and the wafers 10.

As shown in FIG. 4, the work holding unit 52 and small cameras 55 of the image processing unit are provided to the front end section 43 of the arm robot 54.

As shown in FIGS. 5 and 6, the holding unit 52 has a plurality of claws 56 to hold the wafer 10. The three claws 56 are angularly arranged with regular separations. To properly hold the wafer 10, at least three claws 56 are required. The three claws 56 are synchronously opened and closed by a chucking unit 58.

Notches or grooves (not shown), which correspond to the claws 56, are formed, in the carrier 12, for each through-hole 12*a*. When the wafers 10 are fed or discharged, the claws 56 enter the notches, then the claws release or catch the wafer 10. Since the carrier 12 does not spin, the claws 56 and the notches can be easily coincided.

The work holding unit 52 is not limited to the mechanism having the claws 56, a sucking unit, for example, may be employed.

As shown in FIG. 6, in the present embodiment, the three cameras 55 are arranged with regular angular separations so as to recognize the circular wafers 10 and the circular through-holes 12*a* of the carrier 12. The cameras 55 are arranged along an image circle, which is coaxial with an image circle along which the claws 56 of the holding unit 52 are arranged.

The image processing unit processes numeric data, which indicate the position of the wafer 10 with respect to the through-hole 12*a*, so as to precisely control the position of the holding unit 52, which holds the wafer 10, and feed the wafer 10 into the through-hole 12*a*. Namely, the image processing unit detects a gap between the wafer 10 and the through-hole 12*a* so as to verify if the wafer 10 is perfectly fed into the through-hole 12*a* or not. Therefore, the wafer 10 can be securely fed into or discharged from the through-hole 12*a*.

Since the cameras 55 and the holding unit 52 are provided to the front end section 53, the positions and the shapes of the wafer 10 and the through-hole 12*a* can be simultaneously recognized, and the wafers 10 can be efficiently fed into or discharged from the through-holes 12*a*.

The image processing unit can recognized an orientation flat or a notch, which is formed in an edge part of the wafer 10, so that the orientation flat or the notch can be located at a predetermined position. Therefore, the wafers 10 can be abraded under the same conditions, and the wafers 10 can be properly managed during an abrasive step.

The orientation flats or the notches of the wafers 10, which are stored in a cassette, may be previously located at a predetermined position in the cassette by a known manner. In this case, the image processing unit can easily position the wafer 10, and working efficiency can be improved.

In the first embodiment, the carrier 12 is previously stopped at the predetermined position by the stopping means 43. With this action, the through-hole 12*a* can be roughly positioned. Note that, as described above, the stopping means 43 may include the servo mechanism, the sensor system, etc.

When the carrier 12 is roughly positioned at the predetermined position, then the horizontal multi-joint arm robot 54 is actuated. The front end section 53 of the arm is moved to a position above the through-hole 12*a* of the carrier 12, which has been roughly positioned. Since the image processing unit is not used while moving the front end section 53, the front end section 53 can be moved quickly. Then the arm robot 54 is controlled, on the basis of image data processed by the image processing unit, to precisely control the position of the front end section 53, so that the wafer 10 can be fed into the through-hole 12*a*. Since the through-hole 12*a* of the carrier 12 has been roughly positioned at the predetermined position, the front end section 53 is adjusted slightly, so that working efficiency can be improved.

In FIG. 4, a cassette, in which the wafers 10 are stored, is mounted onto a loader cassette section 70. The wafers 10 are centered at a centering section 72 then held by the holding unit 52 and fed into the through-hole 12*a*. A conveyor 74 feeds the wafer 10, which has been stored in the cassette in the loader cassette section 70, to the centering unit 72.

A symbol 76 stands for a water shooter; a symbol 78 stands for a unloaded water cassette section. The water shooter 76 a slope, on which water flows and which guides the wafer 10 in a predetermined direction.

The wafer 10, which has been discharged from the through-hole 12*a* by the arm robot 54, is guided, by the water shooter 76, to a cassette, which is in water reservoired in the unloaded water cassette section 78. Namely, the holding unit releases the wafer 10 above the water shooter 76, so that the wafer 10 is received and guided by the slope of the water shooter 76.

In FIG. 7, a carrier spinning mechanism 80 spins the carrier driving mechanism 20 so as to rotate the carrier 12 until reaching a predetermined angular position.

A holder base 81 supports the carrier driving mechanism 20, which includes the servo motors 32*a*, etc. and which moves round the carrier holder 22 without spinning. The holder base 81 is rotatably provided to the base 30, which rotatably supports the lower abrasive plate 16. Bearings 82 are provided to the base 30 and coaxial with the abrasive plates 14 and 16. The holder base 81 is capable of rotating with the bearings 82. Note that, the lower abrasive plate 16 is driven by a driving mechanism 86, which includes a motor and a reduction gears.

An external gear 83 is fixed to a lower part of the holder base 81. A motor 84 for spinning the carrier 12 is fixed to the base 30. A gear 85 is fixed to an output shaft of the motor 84 and engaged with the external gear 83.

By driving the motor 84, the holder base 81 is rotated about its own axis, so that the carrier 12 can be spun together with the carrier driving mechanism 20 including the carrier holder 22. The through-holes 12*a* are moved round. If the motor 84 is a servo motor, the carrier 12 can be stopped at a prescribed position.

By spinning the carrier 12 and stopping the carrier 12 at the prescribed position, a plurality of the through-holes 12*a* can be located or indexed at the predetermined angular position in order. If the carrier spinning mechanism 80 is combined with the stopping mechanism 43, a plurality of the through-holes 12*a* can be stopped at the predetermined position in order. In this case, an arm robot having a short stroke, e.g., a vertical multi-joint arm robot, may be employed to feed and discharge the wafers 10.

If the horizontal multi-joint arm robot 54 has a long stroke and covers the whole abrasive unit 11, the carrier spinning mechanism 80 is not needed. By moving the front end section 53 of the arm robot 54 to the through-holes 12*a* in order, the wafers 10 can be fed into the through-holes 12*a* in order.

The carrier spinning mechanism 80 need not be spun continuously. For example, when the carrier 12 is rotated 360°, the carrier 12 may be rotated 360° in the reverse direction. With this action, electric codes are never twisted.

The second embodiment will be explained with reference to FIG. 8. Note that, structural elements explained in the first embodiment (see FIG. 4) are assigned the same symbols and explanation will be omitted.

A vertical multi-joint arm robot 90 taken out the wafers 10, which have been vertically stored in a cassette, and vertically stores the wafers 10 into another cassette.

The cassette, in which the wafers 10 are stored, is mounted onto the loader cassette section 70. The wafers 10 are centered at the centering section 72 then held by the holding unit 52 and fed into the through-hole 12*a* as well as the first embodiment.

The wafer 10, which has been discharged from the through-hole 12*a* by the vertical arm robot 90, is guided to a cassette, which is in water reservoired in the unloaded water cassette section 78. A cleaning unit 92 washes and dries the holding unit 52.

The action of the abrasive system of the second embodiment will be explained.

Firstly, an outer edge of the wafer 10, which has been stored in the cassette on the loader cassette section 70, is caught by the three claws 56 of the holding unit 52, and taken out from the cassette.

The wafer 10 taken out is centered by the centering unit 72.

Then the wafer 10 is fed into the through-hole 12*a*. The through-hole 12*a* has been located at the predetermined position by the carrier spinning mechanism 80 and the stopping means 43. The front end section 53 of the arm robot 90 is precisely controlled to correctly feed the wafer 10 into the through-hole 12*a*.

On the other hand, in the case of discharging the wafer 10 from the through-hole 12*a*, the outer edge of the wafer 10 is caught by the three claws 56 of the holding unit 52. Then the front end section 53 is moved to the unloaded water cassette section 78. The wafer 10 is directly stored into the cassette so as to dip the wafer 10 into the water.

Then, the claws 56 (or the sucking unit) of the holding unit 52 is washed in the cleaning unit 92.

In the second embodiment, the arm robot is the vertical multi-joint arm robot 90, so a device for pulling out the wafer from a cassette and a shooter unit, which guides the wafer to a cassette, are not required. Therefore, a simple and compact system can be realized.

In the present embodiments, the wafers are explained as the work pieces. But the present invention can be used to abrade other thin work pieces, e.g., glass plates, non-circular plate members. Further, the abrasive unit may be a polishing unit, a lapping unit, etc.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An abrasive system, comprising:

a carrier being formed into a thin plate having a plurality of through-holes;

an upper abrasive plate and a lower abrasive plate pinching work pieces, each of which is provided in each through-hole, from an upper side and a lower side and abrading both faces of each work piece;

a carrier driving mechanism moving said carrier, in a plane, along a circular orbit without spinning so as to move the work pieces, which are pinched between said abrasive plates, with respect to said abrasive plates, along circular orbits, without spinning, said carrier driving mechanism including a servo motor;

means for stopping a movement of said carrier at a predetermined position, said stopping means being provided to said carrier driving mechanism, said means for stopping including a control unit for controlling said servo motor; and means for feeding and discharging the work pieces, said feeding-and-discharging means including:

an arm robot having a work holding unit, which is provided to a front end and capable of holding and releasing the work piece, said arm robot feeding the work pieces into the plurality of through-holes of said carrier, which is stopped at the predetermined position, and discharging the abraded work pieces therefrom; and an image processing unit for recognizing shapes and positions of the plurality of through-holes of said carrier and the work pieces.

2. The abrasive system according to claim 1, further comprising a carrier spinning mechanism for spinning said carrier about an axis, said carrier spinning mechanism being capable of stopping said carrier at a predetermined angular position.

3. The abrasive system according to claim 1, wherein said arm robot is a horizontal multi-joint robot, and said work holding unit and a camera of said image processing unit are provided to a front end of said horizontal multi-joint robot.

4. The abrasive system according to claim 1, wherein said arm robot is a vertical multi-joint robot, which is capable of taking out the work pieces, which are vertically arranged in a cassette, and vertically storing the work pieces into another cassette.

* * * * *